United States Patent [19]

Toivio et al.

[11] Patent Number: 4,999,867

[45] Date of Patent: Mar. 19, 1991

[54] AIR MATTRESS AND METHOD FOR ADJUSTING IT

[76] Inventors: Ilkka Toivio; Terttu Toivio, both of Likolammenkatu 15, SF-15850 Lahti, Finland

[21] Appl. No.: 209,978

[22] Filed: Jun. 22, 1988

[30] Foreign Application Priority Data

Jun. 24, 1987 [FI] Finland ..... 872813

[51] Int. Cl.[5] ..... A47C 27/10

[52] U.S. Cl. ..... 5/455; 5/453; 428/178

[58] Field of Search ..... 5/449, 455, 453, 441, 5/456; 428/178, 103, 194

[56] References Cited

U.S. PATENT DOCUMENTS

| | | | |
|---|---|---|---|
| 2,751,610 | 6/1956 | Griswold | 5/453 |
| 3,192,540 | 7/1965 | Swank . | |
| 3,736,027 | 5/1973 | Stafford | 5/449 X |
| 3,762,404 | 10/1973 | Sakita | 5/449 X |
| 4,310,936 | 1/1982 | Benjamin | 5/450 |
| 4,428,087 | 1/1984 | Horn | 5/449 |
| 4,467,484 | 8/1984 | Nagatake et al. | 5/449 |
| 4,472,472 | 9/1984 | Schultz | 5/449 X |
| 4,637,083 | 1/1987 | Goodwin | 5/449 X |
| 4,651,369 | 3/1987 | Guldager | 5/455 |
| 4,662,012 | 5/1987 | Torbet | 5/455 X |
| 4,682,378 | 7/1987 | Savenije | 5/455 X |
| 4,686,722 | 8/1987 | Swart | 5/455 X |
| 4,694,520 | 9/1987 | Paul et al. | 5/449 X |
| 4,698,864 | 10/1987 | Graebe | 5/455 X |
| 4,797,962 | 1/1989 | Goode | 5/455 X |

FOREIGN PATENT DOCUMENTS

| | | | |
|---|---|---|---|
| 3535374 | 4/1987 | Fed. Rep. of Germany | 5/455 |
| 959103 | 5/1964 | United Kingdom | 5/456 |
| 1545806 | 5/1979 | United Kingdom . | |
| 2141333 | 12/1984 | United Kingdom | 5/455 |

*Primary Examiner*—Gary L. Smith
*Assistant Examiner*—Michael J. Milano
*Attorney, Agent, or Firm*—Merchant & Gould

[57] ABSTRACT

The invention relates to an air mattress (1) comprising a number of successive, elongate and bag-like elements, which can be filled with gas such as air or with some other flowing medium. The elements are arranged transversely with respect to the lengthwise axis (D—D) of the mattress and/or the bed, and are connected to each other successively in a band-like fashion. The successive elements (2, 2') are arranged so that the lengthwise seam joints (**6; 6*b*) of the elements are located at given intervals in the bottom part (1*b*) of the mattress, and that the areas between these seam joints are arranged to form structures which are directed upwards from the bottom part (1*b*) of the mattress. The invention also relates to a method for adjusting an air mattress or the like. The elements (2, 2'; 9, 10**) of the mattress are partly filled with for instance air, so that the mattress pressure corresponds to the pressure of the surroundings when the mattress elements are not subjected to a weight load, but the mattress pressure grows in a known fashion according to the weight load of the human body or part thereof, so that the mattress elements conform to the contours of the body or part thereof, and simultaneously the surface pressure against the body or part thereof is distributed evenly over the whole body or part thereof.

20 Claims, 3 Drawing Sheets

AIR MATTRESS AND METHOD FOR ADJUSTING IT

BACKGROUND OF THE INVENTION

The present invention relates to a mattress, particularly to an air mattress or the like comprising a number of adjacent, elongate bag-like elements which can be filled with gas such as air, or with some other flowing medium, and which elements are arranged transversally with respect to the longitudinal axis of the mattress and/or the bed or other supporting structure, said elements being connected successively in a bandlike fashion to each other.

The invention also relates to a method for adjusting the said mattress, particularly an air mattress.

In the prior art there are known air mattresses compiled of separate elements, and other corresponding soft beddings, some of these being introduced for instance in the U.S. Pat. No. 3,192,540 and in the GB patent publications Nos. 1,545,806 and 2,141,333. The first of the said publications discloses a pneumatic seat cushion composed of adjacent, elongate compartments, which are inflatable with some pressurized medium such as pressure air. The compartments are separate but connected to each other. They are filled with air up to a desired pressure, whereafter the filler pipe is cut off. Now the compartments rest adjacently against a straight board, and are hemispherical or the like in cross-section. This bedding structure is not sufficiently resilient and solid in order to effectively conform to the forms of the human body, so that it would provide a firm support at the same time. Moreover, the structure is unstable and does not prevent so-called bottom contacts, i.e. the surface layer is at times pressed against the bottom owing to the weight loaded on the mattress.

The Brittish patent application No. 2,141,333 introduces an air mattress composed of separate, adjacently installed air sacs which are interconnected by means of air ducts. The sacs are arranged inside a bed frame structure, transversally with respect to the longitudinal direction of the bed. In addition to this, the sacs are divided into five groups, and each of these groups is connected to the air supply device by means of a separate conduit. This type of mattress requires a special frame structure, whereto the air supply device is also connected as an independent unit. A corresponding mattress suggestion is introduced in the British patent publication No. 1,545,806.

A serious problem in modern nursing is to create a bed environment which causes as little trouble and inconvenience to the patient as possible, and where various tasks connected to the patient's care can be carried out, such as cleaning and washing. Particularly patients who are confined to bed for a long time or permanently, and cannot turn or move their limbs themselves, inevitably get bedsores when lying on ordinary beds and mattresses. The bedsores make the regular care of the patient even more difficult, and serve, among others, as entry routes for various infections. Bedsores are created in places where the surface pressure against the skin is continuously higher than 35–50 cm $H_2O$. These patients must therefore be turned, or their position changed, every two or three hours by nurses. However, the moving or turning of for instance multihandicapped patients may in practice be impossible.

The mattress and bed structures introduced in the above mentioned patent publications GB No. 1 545 806 and GB No. 2,141,333 are designed particularly for hospital environments. In these examples, the air mattress and the bed frame form an inseparable entity. They are complex in structure and expensive to manufacture, and consequently by no means suited to be used as regular mattresses in ordinary homes.

SUMMARY OF THE INVENTION

The purpose of the present invention is to realize a mattress, particularly an air mattress, and a method for adjusting it, whereby the aforementioned drawbacks, among others, can be avoided The air mattress of the present invention is simple in structure and suitable for series production, wherefore the production costs remain moderate Thus the mattress can be used in many different conditions, both in homes and in hospitals.

When the elements of the mattress of the invention are partly filled with gas such as air, so that the gas pressure corresponds to that of the surroundings when the mattress elements are unloaded, but increases in a known fashion according to the weight load of the human body or part thereof directed on the mattress, and in such a fashion that the supporting and resilient top surface of the mattress conforms to the body or part thereof and simultaneously distributes the surface pressure directed against the body or part thereof evenly over the whole body or part thereof.

The air mattress of the invention is disclosed in the appended patent claims 1–11. The method of the invention for adjusting the air mattress is disclosed in the appended patent claims 12–15.

Apart from what has been said above, the advantages of the air mattress of the present invention and of the adjusting method thereof are described in short below. The surface pressure against the skin of the person lying on the bed remains, on each spot pressed against the bedding, such that the capillary circulation can continue without disturbance This is of special importance in hospital surroundings. Normal beds, such as hospital beds, can easily be provided with mattresses according to the present invention whenever necessary. The adjusting method of the mattress is simple and reliable The mattress is easy to use, and the price remains economical in industrial production. In hospital use, it is not necessary to change the position of the patient for example when the patient sleeps. The mattress is convenient for the patient and does not cause any additional trouble or pain.

BRIEF DESCRIPTION OF THE DRAWINGS

In the following the invention and its furtheradvantages are explained in detail with reference to the appended drawings, where.

DESCRIPTION OF THE PREFERRED EMBODIMENTS

Figure 1:
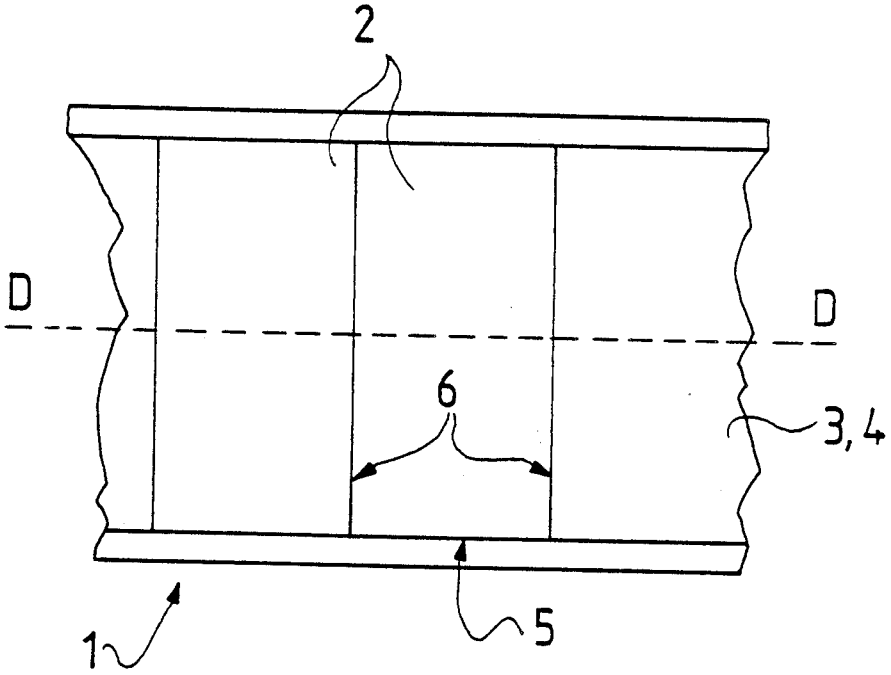
FIG. 1 is a top-view illustration of the basic structure of the mattress of the present invention as spread out.
Figure 3:
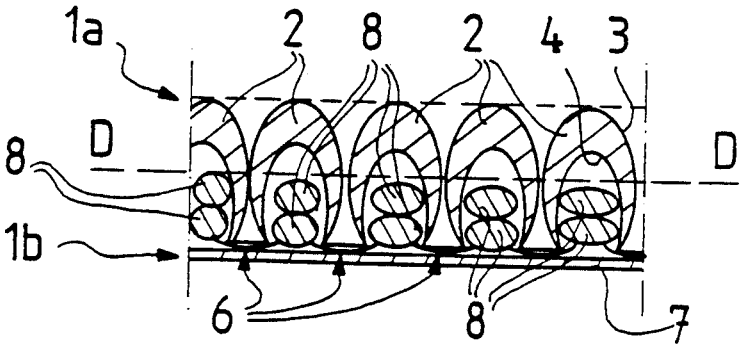
FIG. 3 is a cross-sectional illustration of another mattress of the invention.

The mattress 1 in FIGS. 1 and 3 comprises a number of adjacent, elongate and bag-like elements 2, 2', which can be inflated with air or with some other gas. The elements 2, 2' are arranged transversally with respect to the longitudinal axis D - D of the mattress and/or the bed or some other supporting structure. The elements 2, 2' are interconnected successively in a band-like fashion. Thus the mattress can advantageously be manufactured as a uniform band of first and second overlapping material webs 3, 4, which are connected together in a ladder-like fashion at the seam joints 5, 6. The intervals of the transversal seam joints 6 including one or several seams, form the elements 2, 2' of the mattress. The obtained band is cut into basic sections of suitable lengths, which are for instance 4–6 meters each. The length of the basic section depends, except for the length of the bed, also on how many elements are desired to be included in the bed.

Figure 2:
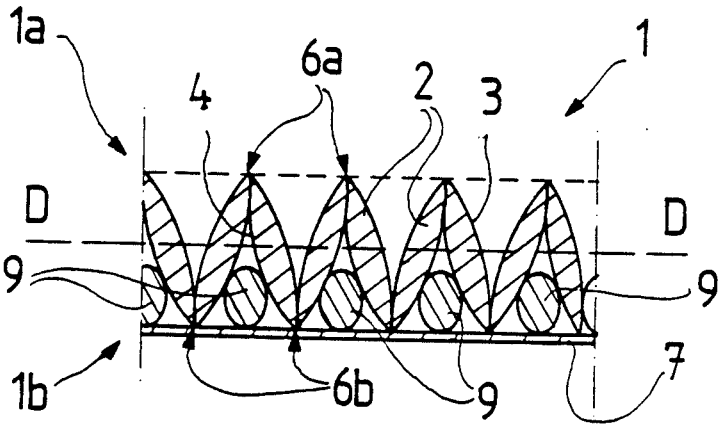
FIG. 2 is a cross-sectional illustration of a mattress of the present invention.

The successive elements 2, 2' are arranged so that lengthwise seam joints 6; **6*b* of the elements are located at given intervals in the bottom part 1*b* of the mattress, and that the areas between these seam joints are arranged to form structures which are directed upwards from the bottom part 1*b* of the mattress In fact the structure between the lengthwise seam joints 6; 6*b* of the elements are bent upward loop-like in cross-section as it can be understood from the FIGS. 2 and 3** of the preferred embodiments.

The successive elements 2, for example in the basic section mentioned above, are in FIG. 2 folded against each other in pairs so that every second longitudinal seam joint **6*a* is located in the top part 1*a* of the mattress, and every second seam joint 6*b* is located in the bottom part 1*b* of the mattress 1**.

Alternatively the successive elements 2' are in FIG. 3 bent to an upside-down U-form so that the longitudinal seam joints 6 of the elements are always located in the bottom part **1*b* of the mattress. In that case the elements 2'** rise like loops up from the bottom.

In the first preferred embodiment of the invention, the basic section of the mattress 1 received from production is folded in the lengthwise direction to form a bed-long mattress with an accordion-like structure (FIG. 2), which is then placed for instance in a bed frame. At the seam joints **6*b* the elements 2 are connected to the underlay 7**, or they are mechanically attached to each other at the sides only.

The basic section of the mattress produced in the manufacturing process can also be compiled to form the mattress proper, so that in the lengthwise direction D—D of the mattress, the elements 2' form loop-like parts protruding upwards from the underlay 7, i.e. successive elements are bent to an upside-down U-form, as was described above (FIG. 3). Now the seam joints 6, which are advantageously relatively broad, are attached adjacently to the underlay 7 so that the elements 2 rise loop-like from the underlay 7.

Beneath the elements 2, 2' of the mattress, there is advantageously arranged some additional padding in order to prevent bottom contact. This padding can be for instance a uniform padding carpet. It can also be realized so that beneath the successive elements 2, 2', and in between the seam joints **6*b*; 6 located in the bottom part 1*b* of the mattress 1, there is placed one or several elongate paddings 8 (FIG. 3), which can be successively interconnected in order to facilitate their production. They can be bag-like elements 9 (FIG. 2**), which are also inflatable with air or with some other gas. On the other hand, these elongate elements can as such be made of some solid but resilient material or filled with the same.

Figure 4:
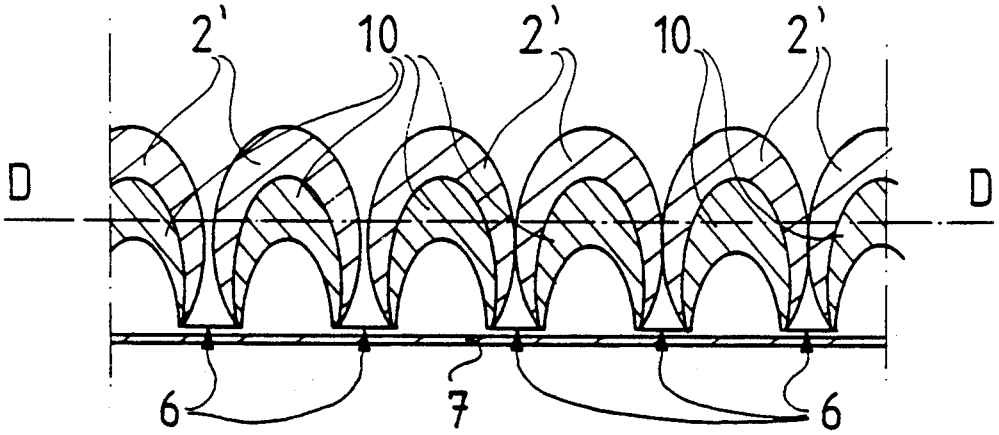
FIG. 4 is a cross-sectional illustration of a third mattress of the invention.

The air mattress of the invention can also be realized so that underneath the first successive elements 2' there is arranged a second set of corresponding successive elements 10, which first and second elements are advantageously connected to each other as is apparent from FIG. 4. This kind of air mattress can be manufactured according to the same principle as the one illustrated in FIG. 1. In the manufacturing process, there is needed only a third material web to be placed on top of the first two, which third web is connected to the rest at the seam joints 5, 6 in a ladder-like fashion.

Figure 5:
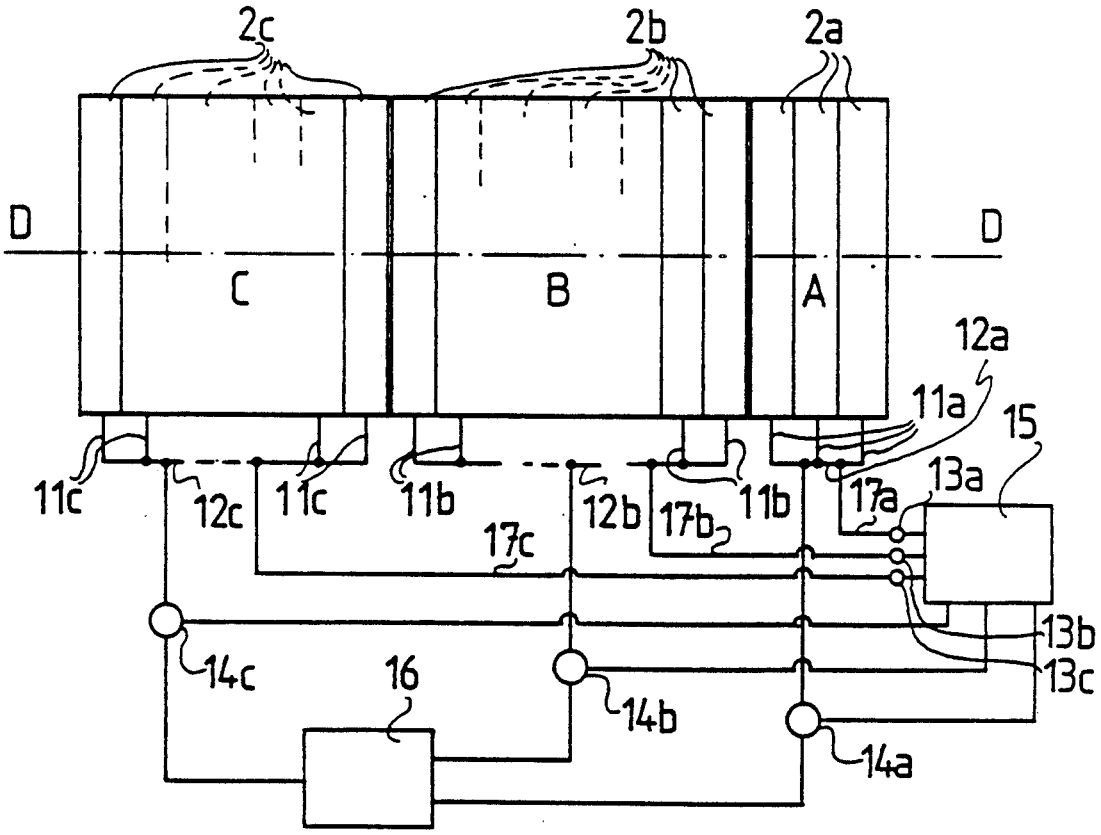
FIG. 5 is a schematical illustration of a mattress of the invention, the mattress being divided into element groups, as well as of the adjusting device and the gas supply source thereof.

The elements 2 of the mattress 1 are advantageously divided at least into three different groups A, B and C in the direction D - D of the lengthwise axis of the mattress, as is illustrated in FIG. 5. The elements of the air mattress are divided into groups for instance so that one of the said groups, for example A, is located under the head of the person lying on the bed, the second, for example B, is located under the middle part of the body, and the third group, for example C, is located under the legs. The elements **2*a*, 2*b*, 2*c* of each group are connected to each other and/or to a connecting duct 12*a*, 12*b*, 12*c* by means of inlet conduits 11*a*, 11*b*, 11*c* such as flexible tubes, and further, via controllable valves 14*a*, 14*b*, 14*c* and a suitable adjusting device 15, whereto the said valves are connected, to the gas supply 16 or the like, such as an air pump, which also is advantageously under the control of the adjusting device 15. By means of the auxiliary conduits 17*a*, 17*b*, 17*c*, the gas pressures prevailing in the various groups are registered in the pressure sensors 13*a*, 13*b*, 13*c*, which are connected to the adjusting unit 15. The pressure sensors 13*a*, 13*b*, 13*a* can also be installed in the connecting ducts 12*a*, 12*b*, 12*c*. The gas pressure of the elements 2*a*, 2*b*, 2*c* of each group A, B, C can thus be measured, adjusted to be suitable and maintained on the desired level particularly when the mattress 1** is being used.

Figure 6:
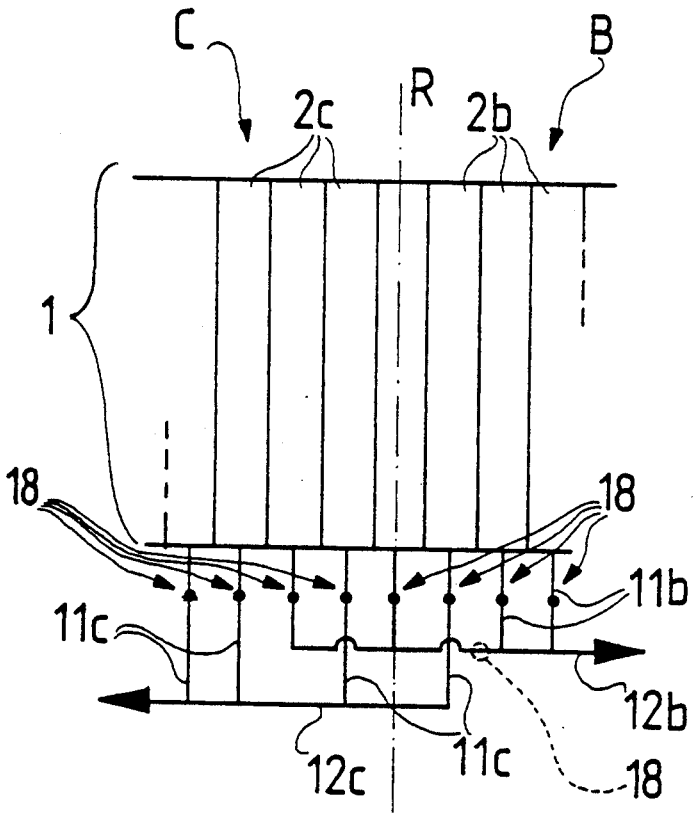
FIG. 6 is a a top-view illustration of a section of a mattress of the invention.

In principle either set of elements 2, 2'; 9, 10, which are air-inflatable and located either in the top or bottom part of the air mattress, can be divided into the said groups. In that case the air pressure in either set of elements is set to be constant, whereas the air pressure in the other set is adjustable. Moreover, the gas pressure in the separate elements can be adjusted to be suitable and maintained on this level when the mattress is in use. In the border areas between the groups A, B and C, the elements of separate groups, such as **2*b* and 2*c* in FIG. 6, can be in turns divided to different groups, for instance into both of the said groups B and C. Thus the groups are interlaced near the boundary surface R to be partly overlapping, so that for instance every second element 2*c* belongs to the group C under the legs, and every second element 2*b*** belongs to the group B under the body. This procedure is advantageously followed only as regards one or two elements placed in the vicinity of the illusory boundary surface R. The advantage of this arrangement is that the person lying on the bed does not feel any clear division of the elements into different groups.

The elements 2a, 2b, 2c of the mattress 1 are connected, via the inlet conduits 11a, 11b, 11c, in groups A, B, C to the connecting ducts 12a, 12b, 12c and to each other, and further to the gas supply 16 such as an air pump or tank or the like, as is illustrated in FIG. 5. The conduits 11 or 12 can be provided with cut-off valves 18, as is apparent from FIG. 6. Each valve functions so that it closes the conduit, such as the inlet conduit 11, when the gas flow surpasses the predetermined limit. Among the advantages of this arrangement let us point out that when the body weight is suddenly shifted, for instance when sitting up in the bed, on top of only a couple of the elements 2 of the mattress, these are not completely flattened out but maintain their supporting effect because the valves 18 prevent the elements from being suddenly exhausted. It is not absolutely necessary to provide the said cut-off valves 18 in connection with all elements 2 of the mattress They can be installed for instance in the elements located in the middle area B of the mattress, or in connection with at least one or two such elements that are likely to be placed under the buttocks of the person lying on the bed. The group B can also be divided into two sub-groups of elements, in between which the cut-off valve 18 is installed.

Figure 7:
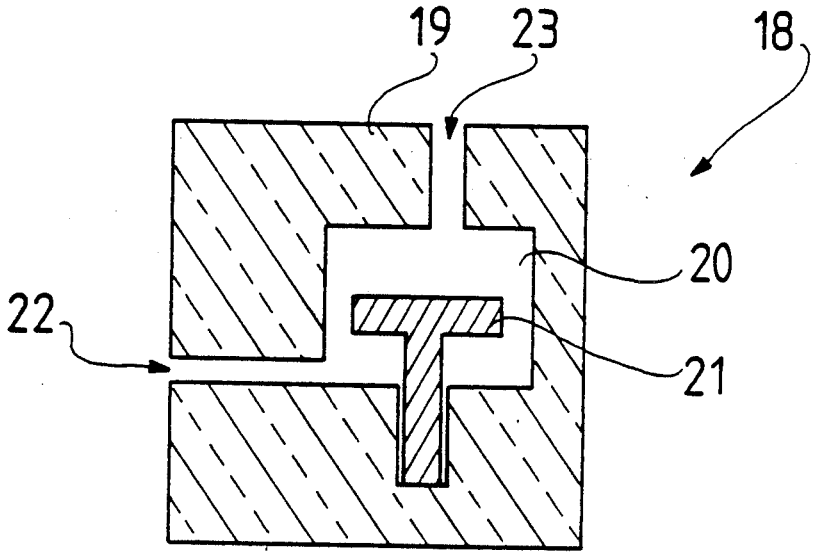
FIG. 7 is an illustration of a valve to be used in connection with the mattress of the invention.

The said cut-off valve 18 is advantageously of the following type illustrated in FIG. 7, but some other type of suitable valve can also be employed. The cut-off valve 18 comprises a housing 19, a chamber 20, which is located inside the housing 19, and a bobber 21 placed in the chamber 20. The cross-sectional surface of the bobber 21 is smaller than the respective surface of the chamber A gas inlet channel 22 is connected to the first end of the chamber, and a gas outlet channel 24 is connected to the second end of the chamber. The bobber 21 is placed in the chamber in between the said inlet and outlet channels 22, 23. The bobber 21 remains at least roughly in place in the chamber 20 when the gas flow is smaller than the predetermined value, but when the gas flow surpasses the predetermined value the bobber is shifted, along with the flow, and closes the outlet channel 23. The cut-off valve 18 advantageously allows the gas to flow in the opposite direction, from the outlet channel into the inlet channel, irrespective of the flow speed. If necessary, the valve can be adjusted, for instance by changing the weight of the bobber or the said surface areas, or by means of suitable spring arrangements.

The heights of the elements 2, 2' of the mattress of the invention, i.e. the thickness of the mattress, is advantageously within the range 10–20 cm,which corresponds to a normal mattress thickness. The width of the mattress 1, and accordingly the width of the elements 2, 2', is chosen according to the specific needs and the measures of the bed. The bed in itself can be any type of normal bed or for instance a hospital bed, whereto an ordinary spring mattress can be placed. The material of which the mattresses are made is plastic or some other flexible and inextensible material which is impermeable to gas or to air.

The method of the invention for adjusting the pressure in the air mattress is based on the idea that underneath the human body or part thereof, there is arranged a supporting gas or air cushion, the pressure p whereof is minimized, and the contact surface A with the body or part thereof is maximized. In order to make the air support the weight m of the body, the pressure p should apparently be $p=m/A$. Let us suppose that the surface area of the human body, from the neck down to the gluteal skinfold, is $A=50\times70$ cm$=3{,}500$ cm$^2$, and the weight m of the upper part of the body $=50$ kg, then the pressure p required in the mattress for supporting the body is about 15 g/cm$^2$, i.e. 15 cm $H_2O \approx 15$ mbar. If a person is laid down on a normal, conventional air mattress, the pressure whereof is the sum of the air pressure and the said pressure, the person sinks down onto the bottom of the mattress, i.e. the mattress is flattened out beneath the patient, and the parts of the mattress which remain outside the person are bulged. The patient is not lifted on top of the bedding before the mattress pressure is remarkably higher than the one calculated above. In the air mattress of the invention, its standard-volume elements reach the calculated pressure, whereafter they are pressed together and shaped so that the contact surface between the human body or parts thereof and the mattress is as large as possible. Each element 2, 2' of the mattress 1, or each group A, B, C of the mattress, is in the method of the invention only partly filled with gas, advantageously with air, and so that the air pressure in each element corresponds to the pressure of the surroundings, i.e. $\approx 1$ bar when the weight load directed thereon is nonexistent. In that case each element is partly compressed. When the human body or part thereof is laid to rest on top of the mattress elements, the pressure p' in each elements grows, according to the weight load of the body or part thereof, after a known fashion $p'=p+m/A$, where p is the earlier pressure, m is the mass of the body or part thereof, and A is the contact surface between the body and the mattress element. Thus the supporting, resilient surface of each element conforms to all protruding parts and recesses of the body or part thereof, and simultaneously distributes the surface pressure against the body etc. evenly over the whole body or part thereof.

The gas pressure in the mattress elements 2, 2' is most suitably set within the range of about 15–25 cm $H_2O$ when the mattress is being used, i.e. somebody is lying on it. The gas pressure in one element is dependent, among other things, on the location of the said element with respect to the body: under the back and the buttocks, the pressure is naturally higher than under the head and the legs.

If the air mattress is formed of the first 2, 2' and the second elements 9; 10, which are placed on top of each other in the mattress (FIGS. 2, 3 and 4), and which elements are both inflatable with gas or air, the gas pressure can be set in either set of the elements, for instance in the first set 2, 2', to a suitable constant value. The gas pressure of the second set of elements 9; 10 is adjusted according to the above described method. Alternatively the pressures of the elements 2, 2' and 9; 10 can be set in the opposite fashion.

The method of the invention is advantageously provided with a method for controlling critical low and high pressures in cases where the mattress is used as a high-class nursing mattress in a hospital or other such institution. Then the mattress is formed to be relatively thick, for instance 15–20 cm, and it allows the use of particularly low gas pressures. The control system is operated so that when the pressure falls below the critical limit either in the mattress 1, in the elements 2, 2' thereof of in one of the groups A, B or C, more gas or air is let or inflated into it. The gas supply is cut off at the critical top limit, for instace when the gas pressure in the elements of group B hasreached the critical limit 15–25 cm $H_2O$. The mattress is also advantageously provided with zero-pressure control: when the gas pressure falls for instance below 10 cm $H_2O$, the air supply is stopped, because it is probable that the mattress is not in normal use. Otherwise the mattress would bulge to excessive pressure when the patient leaves the bed.

In the above described situations the patient "floats" deep in the mattress. For various tasks required in the care of the patient, such as washing, bed-making and cleaning, the mattress can be over-filled and the patient thus be lifted up on top.

In the above description the invention has been described particularly as an air mattress, but the invention can obviously be applied to other corresponding supports, such as seat cushions, which are provided with padding. In the above specification it was also mentioned that the elements of the mattress or the like can be inflated with air or with some other gas. Instead of air or gas, the use of some other flowing medium, such as water, can be applied.

We claim:

1. A mattress comprising:

(a) an underlay;

(b) a plurality of elongate, enclosed, inflatable first elements comprising first and second material webs, said elements being generally parallel to each other and transverse to the longitudinal axis of said mattress, said first elements fixed to said underlay at seam joints along the length of said first elements, such that areas of said first elements between said seam joints are directed away from said underlay; and (c) at least one separate elongate, resilient second element, disposed between said second web of said first element and said underlay.

2. A mattress according to claim 1, wherein the second elements are inflatable.

3. A mattress according to claim 1, wherein the second elements are made of solid resilient material.

4. A mattress according to claim 1, wherein the first elements are connected to each other by means of said longitudinal seam joints.

5. A mattress according to claim 4, wherein the first and second elements are connected to each other at the seam joints.

6. A mattress according to claim 1, wherein the first elements are divided, in the direction of the lengthwise axis of the mattress, into at least three groups, the elements of each of these groups in fluid communication via conduits, through pressure sensors and controllable valves and through an adjusting device to a fluid supply so that the fluid pressure in the elements of each group can be measured and adjusted to be and maintained at the desired level when the mattress is being used.

7. A mattress according to claim 2, wherein the second elements are divided, in the direction of the lengthwise axis of the mattress, into at least three groups, the elements of each of these groups in fluid communication via conduits, through pressure sensors and controllable valves and through an adjusting device to a fluid supply so that the fluid pressure and the elements of each group can be measured and adjusted to be maintained at the desired level when the mattress is being used.

8. A mattress according to claim 6, wherein in the boundary area between the separate groups, the elements of two adjacent groups are in fluid communication with both of the said groups.

9. A mattress according to claim 1, wherein at least one of the elements that the mattress is connected via a conduit and a cut-off valve to at least one of the elements located nearby, so that the cut-off valve closes the conduit when the fluid flow surpasses the predetermined value.

10. A mattress according to claim 9, wherein said cut-off valve comprises a housing having an inlet channel and an outlet channel, a chamber inside said housing in fluid communication with said inlet and outlet channels, and a bobber with a smaller cross-sectional area than the respective surface area of the chamber, said bobber being disposed in said chamber between said inlet and outlet channels and movable between a first position and a second position in which the bobber closes the outlet channel preventing flow in the direction from said inlet channel toward said outlet channel, but allowing flow in the direction from the outlet channel toward the inlet channel, the movement of said bobber actuated by rate of fluid flow through said valve, such that said bobber is moved into said second position when said flow rate is greater than a predetermined rate.

11. A method for adjusting a mattress including a plurality of elongate, enclosed, inflatable first elements comprising first and second material webs, said elements being generally parallel to each other and transverse to the longitudinal axis of the mattress, said first elements fixed to an underlay at a seam joint such that areas of said first elements between seam joints are directed away from the underlay and said mattress further including elongate, resilient second elements disposed between said second web of said first elements and said underlay, comprising the steps of:

(a) partially filling the elements of the mattress with fluid, so that the fluid pressure corresponds to the pressure of the surroundings when the mattress elements are free of a weight load;

laying a human body or part thereof on said elements of the mattress in a resting position;

(c) adjusting the fluid pressure of the elements to within the range of about 15–20 cm $H_2O$;

(d) maintaining the fluid pressure of the elements within a predetermined range.

12. A method according to claim 11 for adjusting a mattress, wherein the fluid pressure of the first elements is set at a standard value, and the fluid pressure of the second elements is set within the range of about 15–20 cm $H_2O$, when the mattress is in use.

13. A method according to claim 11, further comprising the step of stopping fluid supply into the elements when the fluid pressure in the elements falls to about 10 cm $H_2O$.

14. A method according to claim 11 further including the step of maintaining the flow rate out of the elements below a predetermined flow rate.

15. A mattress comprising:

(a) an underlay having upper and lower surfaces;

(b) a plurality of elongate, enclosed, inflatable first elements comprising first and second material webs, said elements being generally parallel to each other and transverse to the longitudinal axis of said mattress, said first elements having first and second longitudinal edges, said edges being fixed to said upper surface such that an elongated cavity is defined between said second web of each said first element and said upper surface of said underlay; and means for supporting said first elements such that said first elements are urged away from said upper surface, said supporting means being disposed within said cavities.

16. A mattress according to claim 15, wherein said supporting means includes at least one elongate, resilient, second element.

17. A mattress according to claim 15, wherein said first elements are divided into three groups along the length of said mattress, said first elements in one said group being in fluid communication with one another.

18. A mattress according to claim 15, wherein said mattress further includes:

(d) means for maintaining fluid pressure within each said first element within a predetermined range, said pressure maintaining means being in fluid communication with said first elements.

19. A mattress according to claim 15, wherein said mattress further includes:

(e) means for preventing fluid from leaving said first elements at a rate higher than a predetermined rate, said preventing means being in fluid communication with said first elements.

20. A mattress according to claim 19, wherein said preventing means includes at least one cut-off valve in fluid communication with one said first element, said valve being constructed and arranged to stop flow from said first element if fluid is flowing out of said element at a rate above a predetermined rate.

* * * * *

UNITED STATES PATENT AND TRADEMARK OFFICE

CERTIFICATE OF CORRECTION

PATENT NO. : 4,999,867

DATED : March 19, 1991

INVENTOR(S) : Ilkka Toivio, Terttu Toivio

It is certified that error appears in the above-identified patent and that said Letters Patent is hereby corrected as shown below:

Column 2, line 39, insert --.-- after the word "disturbance".

Column 2, line 43, insert --.-- after the word "reliable".

Column 2, line 52 & 53, delete "furtheradvantages" and insert --further advantages--.

Column 3, line 29, insert --.-- after the word "mattress".

Column 4, line 10, delete "2'" and insert --2''--.

Column 4, line 41, delete "13a" and insert --13c--.

Column 5, line 18, insert --.-- after the word "mattress".

Column 5, line 32, insert --.-- after the word "chamber".

Column 5, line 48, insert --l-- after the word "mattress".

Column 6, line 22, insert --p-- after the letters "i.e.".

Column 6, line 66, delete "hasreached" and insert --has reached--.

UNITED STATES PATENT AND TRADEMARK OFFICE

CERTIFICATE OF CORRECTION

PATENT NO. : 4,999,867

DATED : March 19, 1991

INVENTOR(S) : Ilkka Toivio, et. al.

It is certified that error appears in the above-indentified patent and that said Letters Patent is hereby corrected as shown below:

Column 8, line 37, insert --(b)-- before the owrd "laying".
line 67, insert --(c)-- before the word "means".

Signed and Sealed this

Twenty-sixth Day of August, 1997

*Attest:*

Bruce Lehman

BRUCE LEHMAN

*Attesting Officer*

*Commissioner of Patents and Trademarks*